US010905633B2

(12) United States Patent
Hayes

(10) Patent No.: US 10,905,633 B2
(45) Date of Patent: Feb. 2, 2021

(54) HEAT SEAL POUCH AND METHOD OF USE THEREOF

(71) Applicant: Scott H. Hayes, Mooresville, NC (US)

(72) Inventor: Scott H. Hayes, Mooresville, NC (US)

( * ) Notice: Subject to any disclaimer, the term of this patent is extended or adjusted under 35 U.S.C. 154(b) by 0 days.

(21) Appl. No.: 15/970,815

(22) Filed: May 3, 2018

(65) Prior Publication Data

US 2018/0318176 A1 Nov. 8, 2018

Related U.S. Application Data

(60) Provisional application No. 62/501,076, filed on May 3, 2017.

(51) Int. Cl.

| | |
|---|---|
| ***A61J 9/00*** | (2006.01) |
| ***A61J 1/20*** | (2006.01) |
| ***A61J 11/04*** | (2006.01) |
| ***B65D 51/28*** | (2006.01) |
| ***B65D 81/32*** | (2006.01) |
| ***A61J 11/00*** | (2006.01) |
| *A61J 1/14* | (2006.01) |

(52) U.S. Cl.

CPC ..... *A61J 9/008* (2013.01); *A61J 1/2058* (2015.05); *A61J 9/005* (2013.01); *A61J 11/008* (2013.01); *A61J 11/04* (2013.01); *B65D 51/2814* (2013.01); *B65D 81/3233* (2013.01); *A61J 1/1475* (2013.01); *A61J 1/2093* (2013.01)

(58) Field of Classification Search

CPC . A61J 9/008; A61J 11/04; A61J 9/005; B65D 1/02

USPC ..... 206/219, 222; 215/11.1–11.4, DIG. 008

See application file for complete search history.

(56) References Cited

U.S. PATENT DOCUMENTS

| | | | | |
|---|---|---|---|---|
| 6,152,296 | A * | 11/2000 | Shih | B65D 51/2835 206/222 |
| 2010/0300904 | A1* | 12/2010 | Sharon | B65D 11/04 206/222 |
| 2016/0023825 | A1* | 1/2016 | Van Den Broek | B65D 81/3211 215/227 |
| 2016/0250106 | A1* | 9/2016 | Rozenbaum | A61J 9/001 215/11.3 |

* cited by examiner

*Primary Examiner* — Anthony D Stashick
*Assistant Examiner* — Raven Collins
(74) *Attorney, Agent, or Firm* — Jeffrey C. Watson; Mathew L. Grell; Grell & Watson Patent Attorneys LLC

(57) ABSTRACT

A heat seal pouch includes a bag, a cylinder, a partition assembly, and an outer skeleton frame. The bag is configured to hold a provided liquid. The cylinder is configured to hold a provided powder. The partition assembly is between the bag and the cylinder. The partition assembly is operable to form an openable partition in a bottom of the cylinder for selectively separating the cylinder from the bag. The outer skeleton frame is configured to house and seal the bag, the cylinder and the partition assembly. Whereby the heat seal pouch is configured for storing, transporting and selectively mixing the provided powder with the provided liquid.

18 Claims, 7 Drawing Sheets

HEAT SEAL POUCH AND METHOD OF USE THEREOF

CROSS-REFERENCE TO RELATED APPLICATIONS

This application claims benefit to U.S. Provisional Patent Application No. 62/501,076, filed on May 3, 2017, which is incorporated by reference in its entirety.

FIELD OF THE DISCLOSURE

The present disclosure is directed to a heat seal pouch and method of use thereof, and more particularly, this disclosure relates to a heat seal pouch device, and method of use thereof, for storing, transporting and/or quickly mixing a provided powder, like dry supplements/formulas, with a provided liquid, like clean or sterile water, when there is a lack of clean sterile water and thus chances for cross contamination.

BACKGROUND

Powder formula, powder nutritional supplements and/or wellness medication are typically measured in proper ratio to the amount of water required for mixing, then added to the water minutes prior to consumption. This approach presents no difficulty at home, but it does impose an inconvenience to people, parents, and caregivers during stressful times when there is a lack of clean water or sterile environments, including, but not limited to, while traveling, during natural disasters, droughts, and in underdeveloped or stressed areas where clean water and/or sterile environments are lacking.

The instant disclosure recognized the problem of providing powder formula, powder nutritional supplements, wellness medications, or other minerals and vitamins that need to be mixed with fluids, like clean and/or sterile water, to various regions throughout the world, like underdeveloped or stressed areas, where there is a lack of clean water and/or sterile environments for mixing the provided minerals and vitamins.

When powder supplements like; dry minerals, vitamins, nutritional supplements, infant formula and/or wellness medications, are shipped to stressed or underdeveloped areas it can take many days, weeks, or even months. The need to ship or transport these materials in a dry form prior to mixing is particularly necessary to preserve the life of the materials. Thus, there is clearly a need for an improved system that allows the user to keep dry powder formula, powder nutritional supplements and/or wellness medications separate from the fluid or water until the time of mixing and consumption by the infant, parent/caregivers and/or the individuals.

The instant disclosure of a heat seal pouch device and method of use thereof is designed to address at least one or more aspects of the above-mentioned problems.

SUMMARY

Accordingly, in one aspect, the present disclosure embraces a heat seal pouch. The heat seal pouch may generally include a bag, a cylinder, a partition assembly, and an outer skeleton frame. The bag may be configured to hold a provided liquid. The cylinder may be configured to hold a provided powder. The partition assembly may be between the bag and the cylinder. The partition assembly may be operable to form an openable partition in a bottom of the cylinder for selectively separating the cylinder from the bag. The outer skeleton frame may be configured to house and seal the bag, the cylinder and the partition assembly. Whereby, the heat seal pouch may be configured for storing, transporting and/or selectively mixing the provided powder with the provided liquid.

In select embodiments of the instant heat seal pouch, the partition assembly may include a plug and a bezel. The plug may be fused to the bottom of the bezel. The bezel may include a flat circle ring and a round circle ring that snap or screw together to form the bezel. Wherein a top of the bag may be positioned through a bottom opening of the bezel and may overlap inner walls of the bezel, where the top of the bag is secured by the bezel between the flat circle ring and the round circle ring.

One feature of the instant heat seal pouch may be that the bag may be a flexible bag.

Another feature of the instant heat seal pouch may be that in select embodiments, the bag may include a fill spout. The fill spout may, but is not limited to, being positioned at a bag bottom, where the fill spout penetrates through an aperture in the outer skeleton frame.

Another feature of the instant heat seal pouch may be that the outer skeleton frame may include a flexible pouch material.

In select embodiments of the instant heat seal pouch, the outer skeleton frame may be attached to the partition assembly to support the partition assembly between the bag and the cylinder. Wherein, in select embodiments, the outer skeleton frame may include an inner support structure connected to a periphery of the partition assembly configured to support the partition assembly between the bag and the cylinder and to prevent the partition assembly from rotating within the outer skeleton frame.

In other select embodiments of the instant heat seal pouch, the cylinder can include a threaded top portion. The threaded top portion may be configured to screw into a threaded neck portion of the outer skeleton frame. As a result, the cylinder may be configured to raise in the outer skeleton frame by rotating the cylinder in the threaded neck portion of the outer skeleton frame. Wherein, when the cylinder is rotated and raised in the outer skeleton frame, the bottom of the cylinder may disengage from a plug of the partition assembly. And, when the cylinder is rotated down and into the outer skeleton frame, the bottom of the cylinder may be sealed with the plug of the partition assembly.

In other select embodiments of the instant heat seal pouch, the partition assembly can include a bezel and a plug. The bezel may be part of a circle top wall forming an inner volume. The plug may extend from the circle top wall. The plug may form a portion of the inner volume. As a result, the partition assembly may be configured for attachment to a top opening of the bag. In addition, the bottom of the cylinder may be configured for removable attachment to the plug. Wherein, the bottom of the cylinder may have an opening configured to receive a portion of the plug within the inner volume of the cylinder. And, the cylinder may be axially slidable about an inner seal in the partition assembly to selectively engage the opening in the bottom of the cylinder with the plug to form a plug seal.

Another feature of the instant heat seal pouch may be that the plug seal forms a first compartment for the provided powder in the cylinder above the plug seal and a second compartment for the provided liquid in the bag below the plug seal. Wherein, the cylinder may be axially slidable to remove the opening in the bottom of the cylinder from the plug so that components held in either of the first compartment or the second compartment can be mixed.

Another feature of the instant heat seal pouch can be the inclusion of a drinkable top. The drinkable top may be attached to the top of the cylinder. The drinkable top may be configured to rotate the cylinder to selectively open the opening in the bottom of the cylinder by twisting to mix the provided powder in the cylinder with the provided liquid in the bag. In select embodiments, as examples and clearly not limited thereto, the drinkable top may be a nipple or a screw top.

Another feature of the instant heat seal pouch may be that the bag can include the provided liquid. In select embodiments, the provided liquid may be, but is clearly not limited to, clean or sterile water.

Another feature of the instant heat seal pouch may be that the cylinder can include the provided powder. In select embodiments, the provided powder may be, but is clearly not limited to, powder formula, powder nutritional supplements, wellness medications, other minerals and vitamins that need to be mixed with fluids like water, the like, and combinations thereof.

In another aspect, the instant disclosure embraces a method of storing, transporting and/or selectively mixing a provided powder with a provided liquid. This method of storing, transporting and/or selectively mixing a provided powder with a provided liquid may generally include the step of providing the heat seal pouch in any of the various embodiments shown and/or described herein. As such, the heat seal pouch provided in the method may generally include a bag, a cylinder, a partition assembly, and an outer skeleton frame. The bag may be configured to hold the provided liquid. The cylinder may be configured to hold the provided powder. The partition assembly may be between the bag and the cylinder. The partition assembly may be operable to form an openable partition in a bottom of the cylinder for selectively separating the cylinder from the bag. The outer skeleton frame may be configured to house and seal the bag, the cylinder and the partition assembly. Whereby, the heat seal pouch may be configured for storing, transporting and/or selectively mixing the provided powder with the provided liquid. With this provided heat seal pouch, the instant method may further include the steps of: storing the provided powder with the provided liquid in the provided heat seal pouch; transporting the provided powder with the provided liquid in the provided heat seal pouch; and/or selectively mixing the provided powder with the provided liquid in the provided heat seal pouch.

In select embodiments of the instant method of storing, transporting and/or selectively mixing a provided powder with a provided liquid, the step of storing the provided powder with the provided liquid in the provided heat seal pouch, or the step of transporting the provided powder with the provided liquid may include the step of: sealing a bottom of the cylinder with a plug in the partition assembly by moving the cylinder down in the outer skeleton frame by twisting the cylinder where a threaded top portion of the cylinder rotates in a threaded neck portion of the outer skeleton frame.

In other select embodiments of the instant method of storing, transporting and/or selectively mixing a provided powder with a provided liquid, the step of selectively mixing the provided powder with the provided liquid in the provided heat seal pouch may include the step of raising the bottom of the cylinder from the plug in the partition assembly by moving the cylinder up in the outer skeleton frame by twisting the cylinder where the threaded top portion of the cylinder rotates in the threaded neck portion of the outer skeleton frame.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

Figure 1:
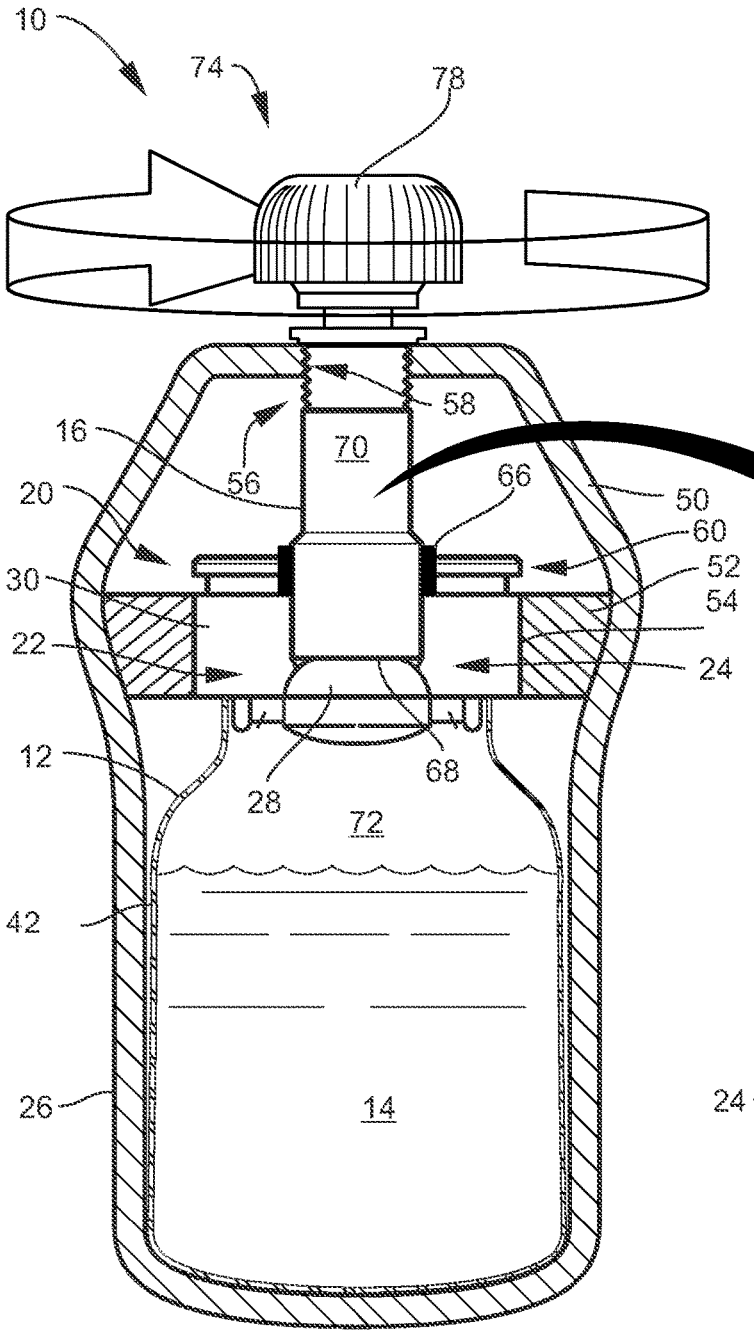
FIG. 1 is a cross-sectional view of one embodiment of the heat seal pouch according to select embodiments of the instant disclosure with a twist top.
Figure 2:
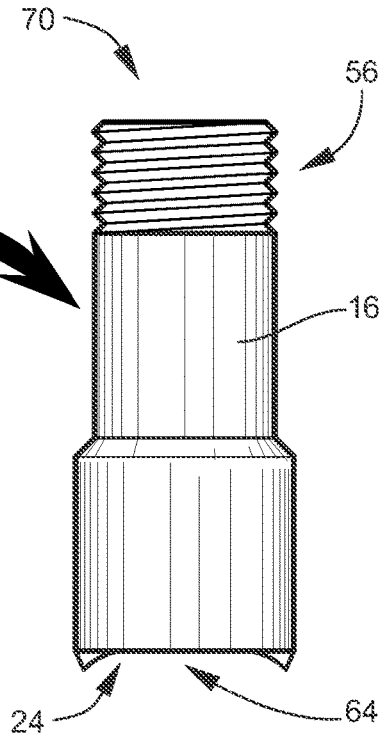
FIG. 2 is a side view of the cylinder for the provided powder according to select embodiments of the instant disclosure of the heat seal pouch.
Figure 3:
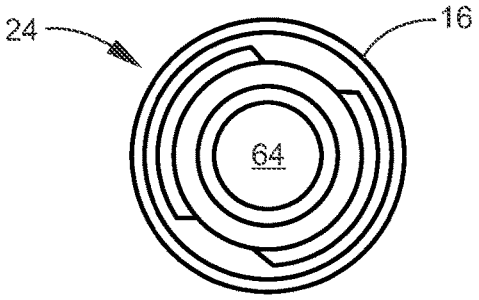
FIG. 3 is a bottom view of the cylinder from FIG. 2.
Figure 4:
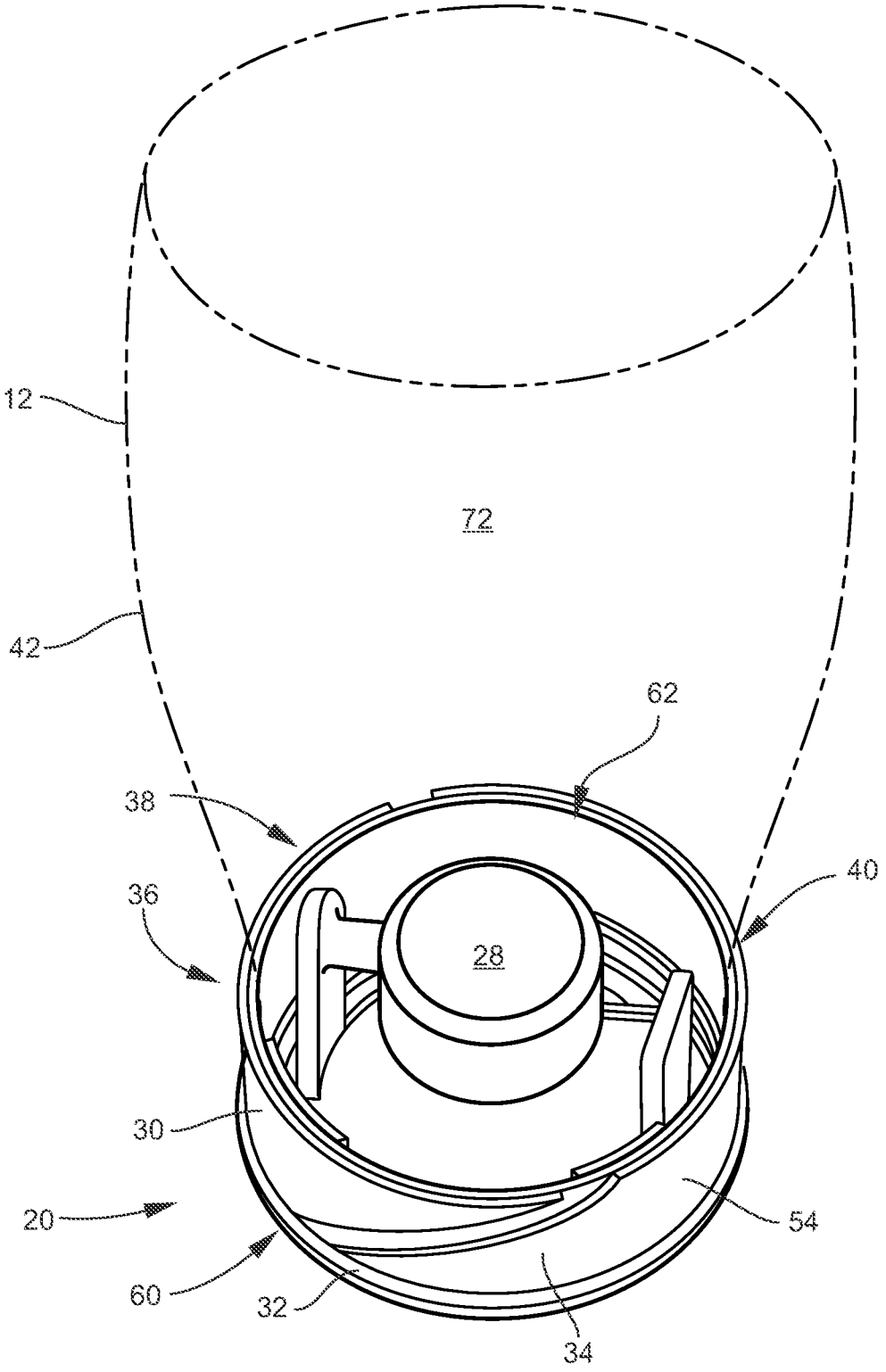
FIG. 4 is a bottom perspective view of the partition assembly with the plug and bezel according to select embodiments of the instant disclosure of the heat seal pouch with the bag attached.
Figure 5A:
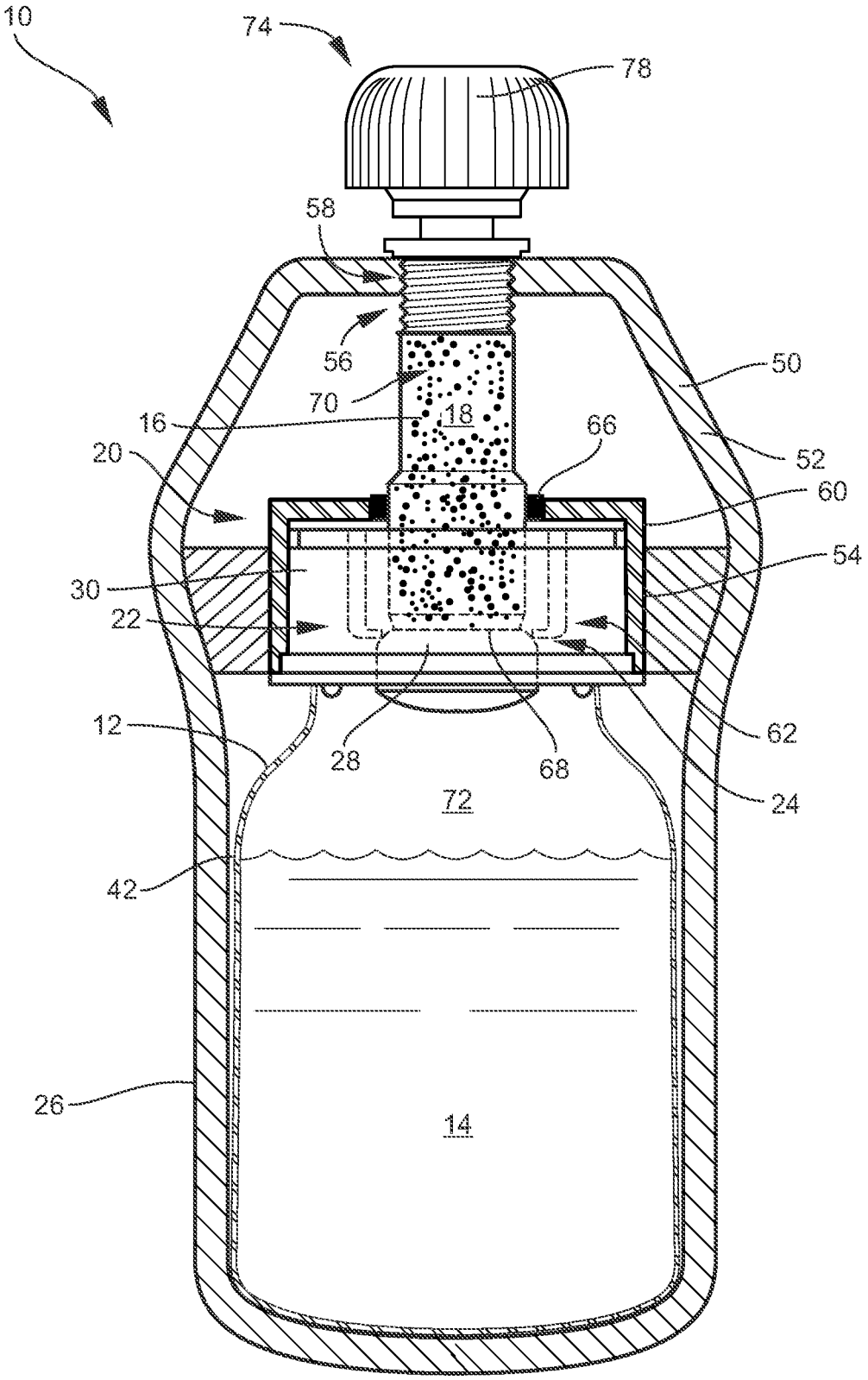
FIG. 5A is a cross-sectional view of one embodiment of the heat seal pouch according to select embodiments of the instant disclosure with the cylinder filled with the provided powder and the bag filled with the provided liquid, where the cylinder is slid or rotated all the way down with the bottom of the cylinder sealed against the plug of the partition assembly for storing and/or transporting the provided powder and the provided liquid.
Figure 5B:
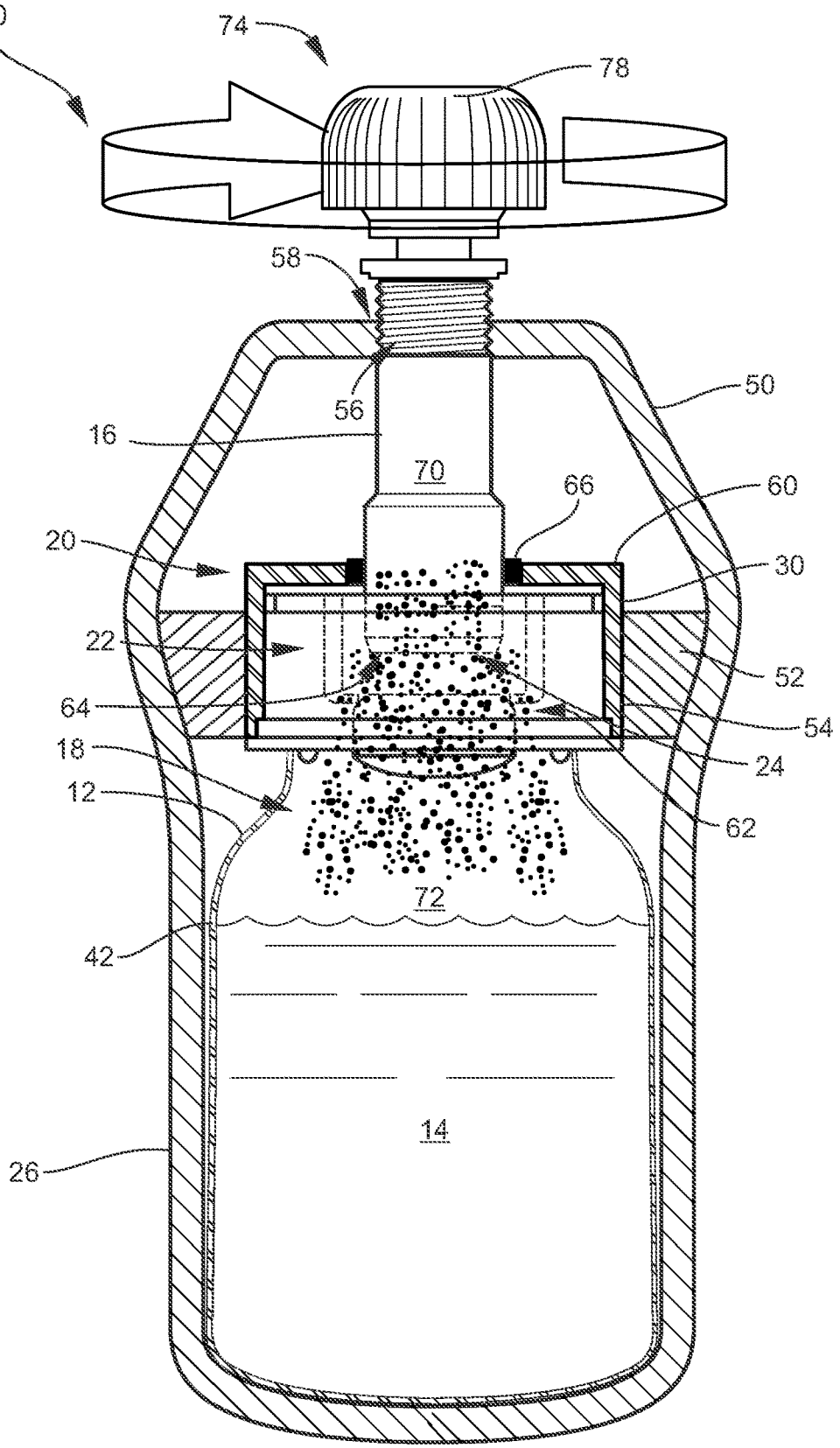
FIG. 5B is a cross-sectional view of the heat seal pouch from FIG. 5A with the cylinder slid up by turning the top threaded portion of the cylinder within the threaded neck of the outer skeleton frame, whereby the bottom of the cylinder is unsealed from the plug and the provided powder is falling out of the cylinder and into the bag for mixing with the provided liquid.
Figure 5C:
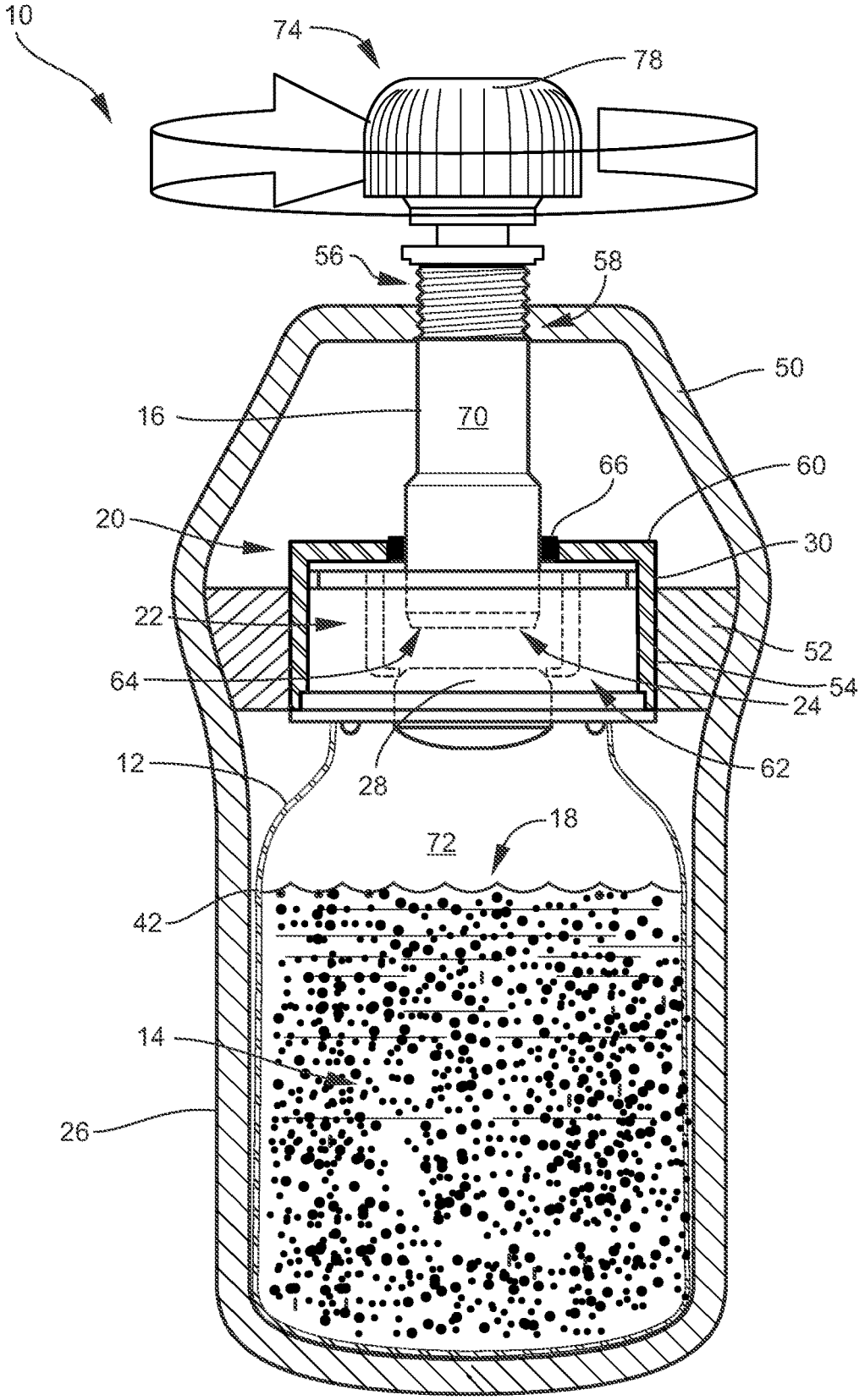
FIG. 5C is a cross-sectional view of the heat seal pouch from FIG. 5A with the cylinder slid up by turning the top threaded portion of the cylinder within the threaded neck of the outer skeleton frame, whereby the bottom of the cylinder is unsealed from the plug and the provided powder has fallen out of the cylinder and into the bag and has been mixed with the provided liquid.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-8, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-7, in a possibly preferred embodiment, the present disclosure overcomes the above-mentioned disadvantages and meets the recognized need for such an apparatus or method by providing of heat seal pouch 10. Heat seal pouch 10 may be for storing, transporting, and/or selectively mixing provided powder 18 with provided liquid 14. Heat seal pouch 10 may have the outer appearance of a food or drink pouch, like an applesauce pouch, baby food pouch, the like, etc. However, heat seal pouch 10 may have an inside that allows provided powder 18 to be stored and/or transported inside heat seal pouch 10 without mixing with provided liquid 14. When desired, heat seal pouch 10 may allow the user to selectively mix the provided powder 18 with the provided liquid 14. Heat seal pouch 10 may generally include bag 12, cylinder 16, partition assembly 20, and outer skeleton frame 26.

Figure 6:
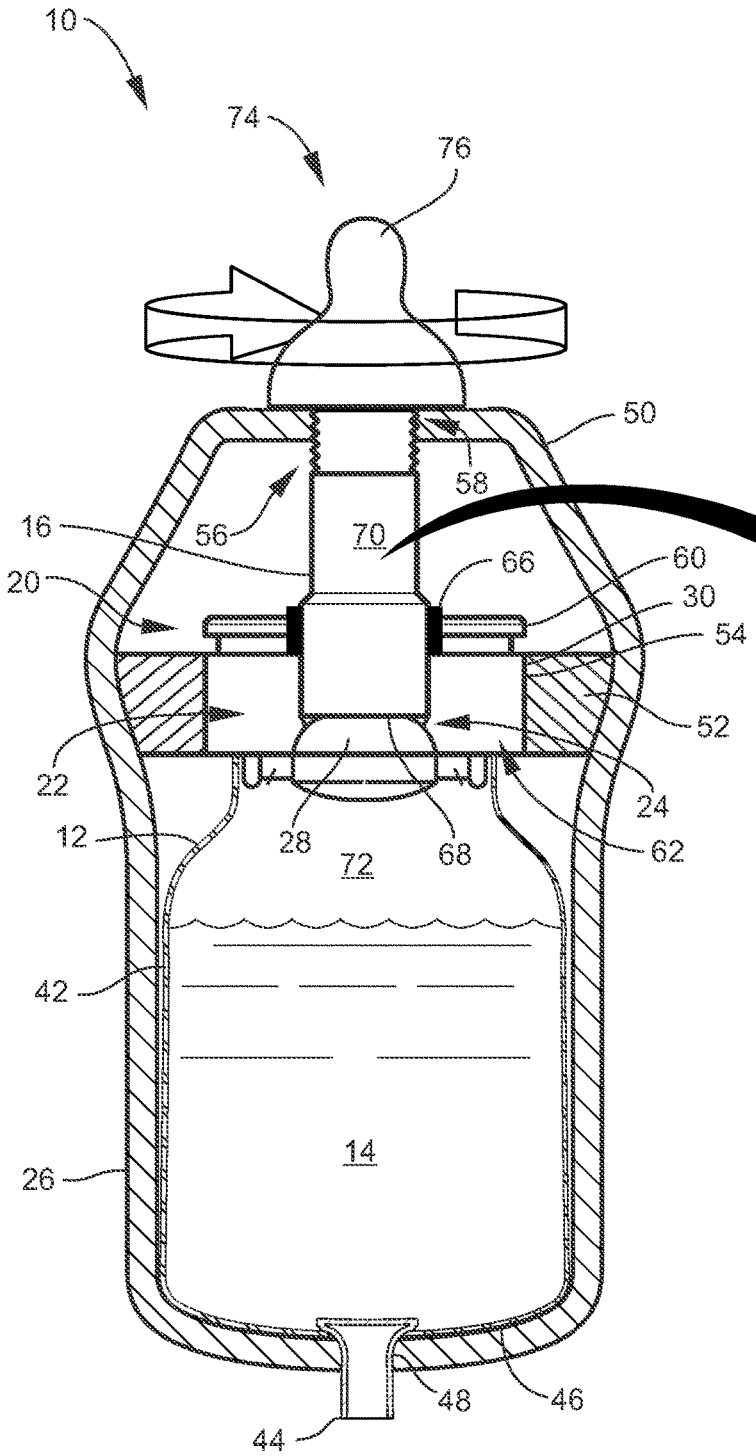
FIG. 6 is a cross-sectional view of one embodiment of the heat seal pouch according to select embodiments of the instant disclosure with a nipple top and a fill spout.
Figure 7:
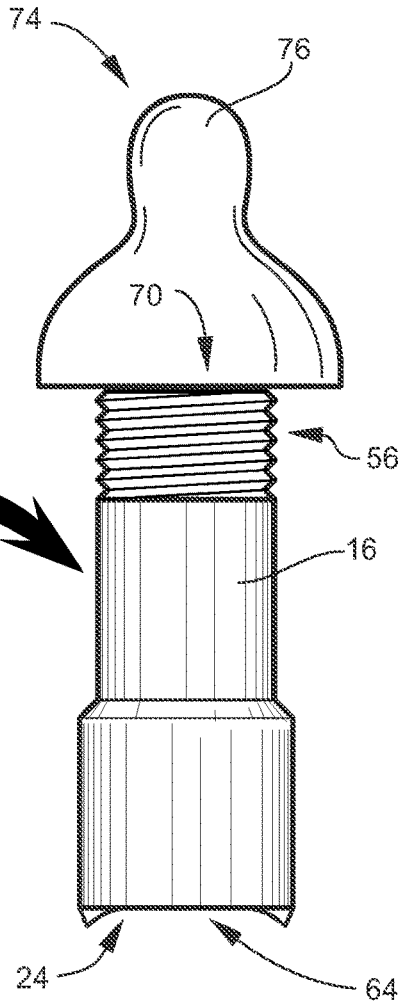
FIG. 7 is a side view of the cylinder for the provided powder according to select embodiments of the instant disclosure of the heat seal pouch with the nipple top fixed thereto.

Bag 12 may be included in heat seal pouch 10. Bag 12 may be for holding provided liquid 14 and for providing a compartment for mixing provided powder 18 with provided liquid 14. Bag 12 may be configured to hold provided liquid 14. Bag 12 may be made from a flexible material, including, but not limited to, a plastic bag. As such, in select embodiments, bag 12 may be flexible bag 42. Referring now to FIG. 6, in select embodiments, bag 12 may include optional fill spout 44. Fill spout 44 may allow heat seal pouch 10 to be filled with liquid in bag 12 at any point in the storage and/or transportation of heat seal pouch 10. Fill spout 44 may, but is not limited to, be positioned at bag bottom 46, where fill spout 44 may penetrate through aperture 48 in outer skeleton frame 26.

Cylinder 16 may be included in heat seal pouch 10. Cylinder 16 may be for holding and storing provided powder 18. Cylinder 16 may also be designed to move within heat seal pouch 10 for selectively opening bottom 24 for releasing provided powder 18 into bag 12 for mixing with provided liquid 14. As such, cylinder 16 may be configured to hold provided powder 18. In select embodiments of the instant heat seal pouch 10, cylinder 16 can include threaded top portion 56. Threaded top portion 56 may be configured to screw into threaded neck portion 58 of outer skeleton frame 26. As a result, cylinder 16 may be configured to raise in outer skeleton frame 26 by rotating cylinder 16 in threaded neck portion 58 of outer skeleton frame 26. Wherein, when cylinder 16 is rotated and raised in outer skeleton frame 26, bottom 24 of cylinder 16 may disengage from plug 28 of partition assembly 20 (see FIGS. 5B and 5C). Likewise, when cylinder 16 is rotated the other direction and moves down and into outer skeleton frame 26, bottom 24 of cylinder 16 may be sealed with plug 28 of partition assembly 20 (see FIG. 5A).

Partition assembly 20 may be included in heat seal pouch 10. Partition assembly 20 may be for providing an openable partition, divider, door, the like, etc. between cylinder 16 and bag 12. As such, partition assembly 20 may be positioned between bag 12 and cylinder 16. Partition assembly 20 may be operable to form openable partition 22 in bottom 24 of cylinder 16 for selectively separating cylinder 16 from bag 12. Partition assembly may include any device, devices, mechanisms, members, parts, means, the like, etc. configured to form openable partition 22 in bottom 24 of cylinder 16 for selectively separating cylinder 16 from bag 12. In select embodiments of heat seal pouch 10, partition assembly 20 may include plug 28 and bezel 30. Plug 28 may be fused or attached to the bottom of bezel 30. Bezel 30 may include flat circle ring 32 and round circle ring 34 that snap or screw together to form bezel 30. Wherein, top 36 of bag 12 may be positioned through bottom opening 38 of bezel 30 and may overlap inner walls 40 of bezel 30. Whereby, top 36 of bag 12 may be secured by bezel 30 between flat circle ring 32 and round circle ring 34. In other select embodiments of heat seal pouch 10, partition assembly 20, bezel 30 may be part of circle top wall 60 forming inner volume 62. Plug 28 may extend from circle top wall 60. Plug 28 may form a portion of inner volume 62. As a result, partition assembly 20 may be configured for attachment to top opening 36 of bag 12. In addition, bottom 24 of cylinder 16 (see FIG. 3) may be configured for removable attachment to plug 28. Wherein, bottom 24 of cylinder 16 may have opening 64 configured to receive at least a portion of plug 28 within inner volume 62 of cylinder 16. For keeping provided liquid 14 in bag 12, cylinder 16 may be axially slidable about inner seal 66 in partition assembly 20. This axially slidable feature of cylinder 16 within inner seal 66 of partition assembly 20 may allow for selectively engaging opening 64 in bottom 24 of cylinder 16 with plug 28 to form plug seal 68. Plug seal 68 may form first compartment 70 for provided powder 18 in cylinder 16 above plug seal 68, and second compartment 72 for provided liquid 14 in bag 12 below plug seal 68. Wherein, cylinder 16 may be axially slidable to remove opening 64 in bottom 24 of cylinder 16 from plug 28 so that components held in either of first compartment 70 or second compartment 72 can be mixed. Partition assembly 20 may be similar to the plug assembly disclosed by the instant inventors in U.S. patent application Ser. No. 12/564,171, now issued as U.S. Pat. No. 9,629,782, which is a continuation-in-part application to U.S. Pat. No. 7,850,027, which claims the benefit of U.S. Provisional Patent No. 60/811,970, all of which are incorporated herein in their entireties.

Outer skeleton frame 26 may be included with heat seal pouch 10. Outer skeleton frame may be for sealing bag 12, cylinder 16, and partition assembly 20 inside heat seal pouch 10. Outer skeleton frame 26 may thus be configured to house and seal bag 12, cylinder 16, and partition assembly 20. Outer skeleton frame 26 may include flexible pouch material 50. Flexible pouch material 50 may be similar to the outer material of a food or drink pouch, like an applesauce pouch, baby food pouch, the like, etc. In select embodiments of heat seal pouch 10, outer skeleton frame 26 may be attached to partition assembly 20 to support partition assembly 20 between bag 12 and cylinder 16. Wherein, in select embodiments, outer skeleton frame 26 may include inner support structure 52 connected to periphery 54 of partition assembly 20 configured to support partition assembly 20 between bag 12 and cylinder 16. Inner support structure 52 may be configured to prevent partition assembly 20 from rotating within outer skeleton frame 26.

Another feature of heat seal pouch 10 can be the inclusion of drinkable top 74. Drinkable top 74 may be for providing a top for allowing a user to drink the mixed contents inside heat seal pouch 10. Drinkable top 74 may also be for providing a location for gripping cylinder 16 for rotating threaded top 56 of cylinder 16 within threaded neck 58 of outer skeleton frame 26. As shown in FIG. 6, drinkable top 74 may be attached to the top of cylinder 16. Drinkable top 74 may be configured to rotate cylinder 16 to selectively open opening 64 in bottom 24 of cylinder 16 by twisting to mix provided powder 18 in cylinder 16 with provided liquid 14 in bag 12. In select embodiments, as examples and clearly not limited thereto, drinkable top 74 may be nipple 76 (see FIG. 6) or screw top 78 (see FIGS. 1, 5A, 5B, and 5C). For the screw top 78 embodiments of drinkable top 74, threaded top portion 56 and may be reverse threaded from screw top 78, whereby, partition assembly 20 may be opened for mixing by rotating screw top 78 in one direction, and screw top 78 may be removed from the top of cylinder 16 by rotating screw top 78 in the other direction.

As shown in the Figures, heat seal pouch 10 may be configured or provided where bag 12 can include provided liquid 14. In select embodiments, provided liquid 14 may be, but is clearly not limited to, clean or sterile water.

Also as shown in the Figures, heat seal pouch 10 may be configured or provided where cylinder 16 can include provided powder 18. In select embodiments, provided powder 18 may be, but is clearly not limited to, powder formula, powder nutritional supplements, wellness medications, other minerals and vitamins that need to be mixed with fluids like water, the like, and combinations thereof.

Figure 8:
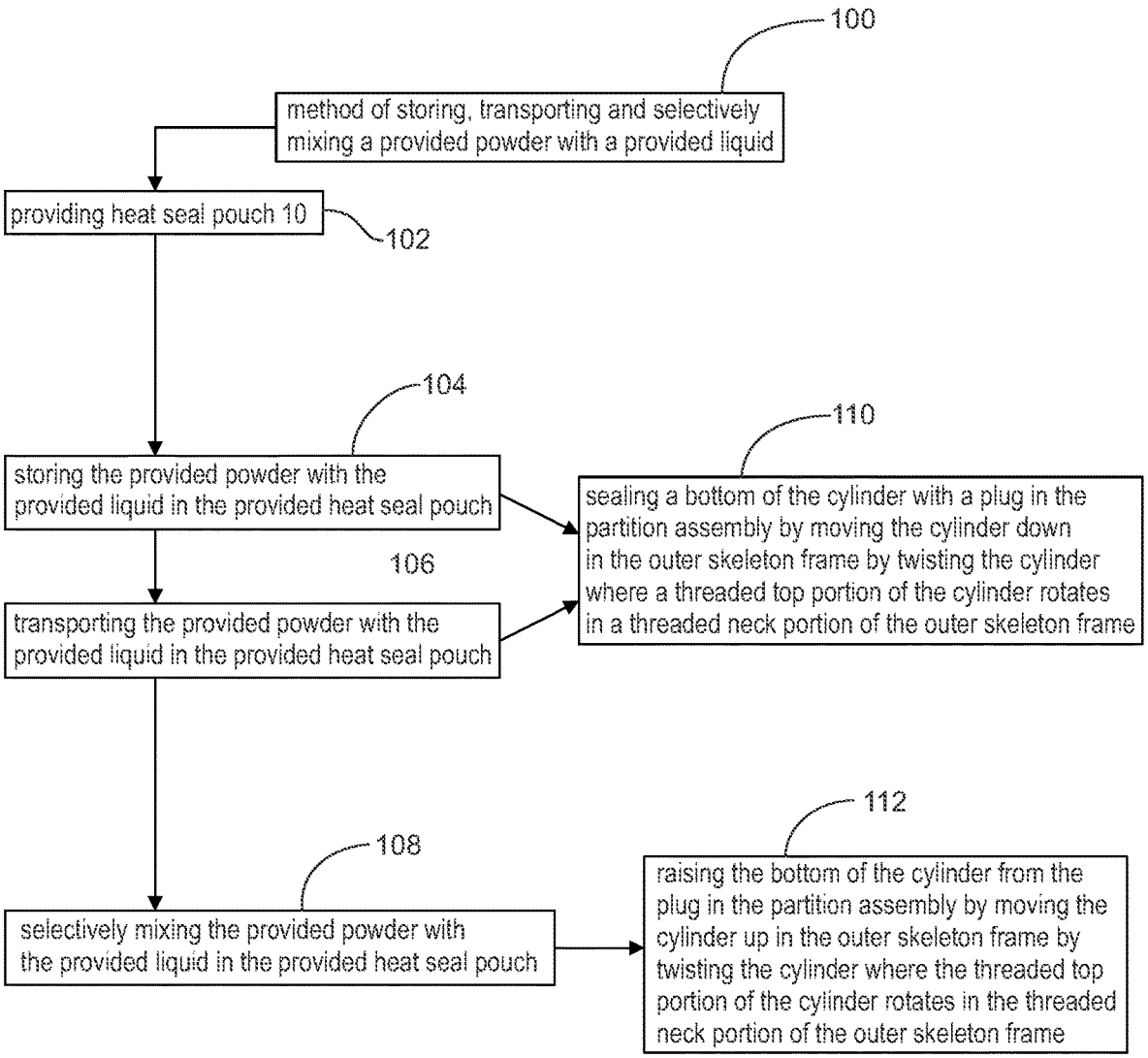
FIG. 8 is a flow diagram of the method of storing, transporting, and/or selectively mixing a provided powder with a provided liquid according to select embodiments of the instant disclosure.

Referring now to FIG. 8, in another aspect, the instant disclosure embraces method 100 of storing, transporting and/or selectively mixing provided powder 18 with provided liquid 14. Method 100 of storing, transporting and/or selectively mixing provided powder 18 with provided liquid 14 may generally include step 102 of providing heat seal pouch 10 in any of the various embodiments shown and/or described herein. As such, heat seal pouch 10 provided in method 100 may generally include bag 12, cylinder 16, partition assembly 20, and outer skeleton frame 26. Bag 12 may be configured to hold provided liquid 14. Cylinder 16 may be configured to hold provided powder 18. Partition assembly 20 may be between bag 12 and cylinder 16. Partition assembly 20 may be operable to form openable partition 22 in bottom 24 of cylinder 16 for selectively separating cylinder 16 from bag 12. Outer skeleton frame 26 may be configured to house and seal bag 12, cylinder 16 and partition assembly 20. Whereby, the provided heat seal pouch 10 may be configured for storing, transporting and/or selectively mixing provided powder 18 with provided liquid 14. With this provided heat seal pouch 10, method 100 may further include the steps of: step 104 of storing provided powder 18 with provided liquid 14 in the provided heat seal pouch 10; step 106 of transporting provided powder 18 with provided liquid 14 in the provided heat seal pouch 10; and/or step 108 of selectively mixing provided powder 18 with provided liquid 14 in provided heat seal pouch 10.

In select embodiments of method 100 of storing, transporting and/or selectively mixing provided powder 18 with provided liquid 14, step 104 of storing provided powder 18 with provided liquid 14 in the provided heat seal pouch 10, or step 106 of transporting provided powder 18 with provided liquid 14 may include step 110 of sealing bottom 24 of cylinder 16 with plug 28 in partition assembly 20 by moving cylinder 16 down in outer skeleton frame 26 by twisting cylinder 16 where threaded top portion 56 of cylinder 16 rotates in threaded neck 58 portion of outer skeleton frame 26.

In other select embodiments of method 100 of storing, transporting and/or selectively mixing provided powder 18 with provided liquid 14, step 108 of selectively mixing provided powder 18 with provided liquid 14 in the provided heat seal pouch 10 may include step 112 of raising bottom 24 of cylinder 16 from plug 28 in partition assembly 20 by moving cylinder 16 up in outer skeleton frame 26 by twisting cylinder 16 where threaded top portion 56 of cylinder 16 rotates in threaded neck portion 58 of outer skeleton frame 26.

In sum, the instant disclosure provides heat seal pouch 10 which may be designed for storing, transporting and/or quickly mixing dry supplements/formula with a provided liquid, like clean or sterile water, when there is a lack of clean sterile water and thus chances for cross contamination. Heat seal pouch 10 may allow a user to store, transport and, when desired, selectively mix provided powder 18 with provided liquid 14 in a sealed sterile manner.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A heat seal pouch comprising:

a bag configured to hold a provided liquid;

a cylinder configured to hold a provided powder;

a partition assembly between the bag and the cylinder, the partition assembly being operable to form an openable partition in a bottom of the cylinder for selectively separating the cylinder from the bag; and an outer skeleton frame configured to house and seal the bag, the cylinder and the partition assembly;

wherein:

the partition assembly including a plug fused to a bezel;

the bezel including a flat circle ring and a round circle ring that snap or screw together to form the bezel;

wherein a top of said bag comes through a bottom opening of said bezel and overlaps inner walls of said bezel, where the top of said bag is secured by said bezel between said flat circle ring and said round circle ring.

2. The heat seal pouch of claim 1, whereby the heat seal pouch is configured for storing, transporting and selectively mixing the provided powder with the provided liquid.

3. The heat seal pouch according to claim 1, wherein said bag being a flexible bag.

4. The heat seal pouch according to claim 1 wherein said bag including a fill spout at a bag bottom, where the fill spout penetrates through an aperture in the outer skeleton frame.

5. The heat seal pouch according to claim 1, wherein the outer skeleton frame includes a flexible pouch material.

6. The heat seal pouch of claim 1, wherein the outer skeleton frame is attached to the partition assembly to support the partition assembly between the bag and the cylinder, wherein the outer skeleton frame including an inner support structure connected to a periphery of the partition assembly configured to support the partition assembly between the bag and the cylinder and to prevent the partition assembly from rotating within the outer skeleton frame.

7. The heat seal pouch according to claim 1, wherein:

the cylinder including a threaded top portion configured to screw into a threaded neck portion of said outer skeleton frame;

the cylinder is configured to raise in the outer skeleton frame by rotating the cylinder in the threaded neck portion of the outer skeleton frame;

wherein, when the cylinder is rotated and raised in the outer skeleton frame, the bottom of the cylinder disengages from a plug of the partition assembly.

8. The heat seal pouch according to claim 7, wherein, when the cylinder is rotated down and into the outer skeleton frame, the bottom of the cylinder is sealed with the plug of the partition assembly.

9. The heat seal pouch according to claim 1, wherein said partition assembly comprising:

a bezel, the bezel is part of a circle top wall forming an inner volume, a plug extending from the circle top wall, the plug forming a portion of the inner volume;

the partition assembly being configured for attachment to a top opening of the bag; and a bottom of the cylinder being configured for removable attachment to the plug;

wherein the bottom of the cylinder having an opening configured to receive a portion of the plug within the inner volume of the cylinder; and the cylinder is axially slidable about an inner seal in the partition assembly to selectively engage the opening in the bottom of the cylinder with the plug to form a plug seal.

10. The heat seal pouch of claim 9, wherein the plug seal forms a first compartment for the provided powder in the cylinder above the plug seal and a second compartment for the provided liquid in the bag below the plug seal.

11. The heat seal pouch of claim 10, wherein the cylinder is axially slidable to remove the opening in the bottom of the cylinder from the plug so that components held in either of the first compartment or the second compartment can be mixed.

12. The heat seal pouch of claim 1 further comprising a drinkable top attached to the top of the cylinder, the drinkable top being configured to rotate the cylinder to selectively open the opening in the bottom of the cylinder by twisting to mix the provided powder in the cylinder with the provided liquid in the bag.

13. The heat seal pouch of claim 12, wherein the drinkable top being a nipple or a screw top.

14. The heat seal pouch according to claim 1 wherein:

said bag including the provided liquid, where the provided liquid being clean or sterile water; and said cylinder including the provided powder.

15. The heat seal pouch according to claim 14, wherein said provided powder being selected from a group consisting of: powder formula; powder nutritional supplements; wellness medications; other minerals and vitamins that need to be mixed with fluids like water; and combinations thereof.

16. A heat seal pouch comprising:

a bag being a flexible bag configured to hold a provided liquid;

a cylinder configured to hold a provided powder;

a partition assembly between the bag and the cylinder, the partition assembly being operable to form an openable partition in a bottom of the cylinder for selectively separating the cylinder from the bag, the partition assembly including a plug fused to the bottom of a bezel, the bezel including a flat circle ring and a round circle ring that snap or screw together to form the bezel, wherein a top of said bag comes through a bottom opening of said bezel and overlaps inner walls of said bezel, where the top of said bag is secured by said bezel between said flat circle ring and said round circle ring;

said partition assembly comprising:

a bezel, the bezel is part of a circle top wall forming an inner volume, a plug extending from the circle top wall, the plug forming a portion of the inner volume;

the partition assembly being configured for attachment to a top opening of the bag; and a bottom of the cylinder being configured for removable attachment to the plug;

wherein the bottom of the cylinder having an opening configured to receive a portion of the plug within the inner volume of the cylinder; and the cylinder is axially slidable about an inner seal in the partition assembly to selectively engage the opening in the bottom of the cylinder with the plug to form a plug seal an outer skeleton frame configured to house and seal the bag, the cylinder and the partition assembly, the outer skeleton frame is configured as a flexible pouch, the outer skeleton frame is attached to the partition assembly to support the partition assembly between the bag and the cylinder, the outer skeleton frame including an inner support structure connected to a periphery of the partition assembly configured to support the partition assembly between the bag and the cylinder and to prevent the partition assembly from rotating within the outer skeleton frame;

the cylinder including a threaded top portion configured to screw into a threaded neck portion of said outer skeleton frame, the cylinder is configured to raise in the outer skeleton frame by rotating the cylinder in the threaded neck portion of the outer skeleton frame, wherein, when the cylinder is rotated and raised in the outer skeleton frame, the bottom of the cylinder disengages from a plug of the partition assembly, wherein, when the cylinder is rotated down and into the outer skeleton frame, the bottom of the cylinder is sealed with the plug of the partition assembly;

wherein the plug seal forms a first compartment for the provided powder in the cylinder above the plug seal and a second compartment for the provided liquid in the bag below the plug seal, wherein the cylinder is axially slidable to remove the opening in the bottom of the cylinder from the plug so that components held in either of the first compartment or the second compartment can be mixed; and a drinkable top attached to the top of the cylinder, the drinkable top being configured to rotate the cylinder to selectively open the opening in the bottom of the cylinder by twisting to mix the provided powder in the cylinder with the provided liquid in the bag, wherein the drinkable top being a nipple or a screw top;

wherein, said bag including the provided liquid, where the provided liquid being clean or sterile water; and wherein, said cylinder including the provided powder, the provided powder being selected from a group consisting of: powder formula; powder nutritional supplements; wellness medications; other minerals and vitamins that need to be mixed with fluids like water; and combinations thereof;

whereby the heat seal pouch is configured for transporting and selectively mixing the provided powder with the provided liquid.

17. The heat seal pouch according to claim 16 wherein said bag including a fill spout at a bag bottom, where the fill spout penetrates through the outer skeleton frame.

18. A heat seal pouch comprising:

a bag configured to hold a provided liquid;

a cylinder configured to hold a provided powder;

a partition assembly between the bag and the cylinder, the partition assembly being operable to form an openable partition in a bottom of the cylinder for selectively separating the cylinder from the bag; and an outer skeleton frame configured to house and seal the bag, the cylinder and the partition assembly;

wherein said partition assembly comprising:

a bezel, the bezel is part of a circle top wall forming an inner volume;

a plug extending from the circle top wall, the plug forming a portion of the inner volume;

the partition assembly being configured for attachment to a top opening of the bag; and a bottom of the cylinder being configured for removable attachment to the plug;

wherein the bottom of the cylinder having an opening configured to receive a portion of the plug within the inner volume of the cylinder; and the cylinder is axially slidable about an inner seal in the partition assembly to selectively engage the opening in the bottom of the cylinder with the plug to form a plug seal.

* * * * *